US007995786B2

(12) United States Patent
Yu

(10) Patent No.: US 7,995,786 B2
(45) Date of Patent: Aug. 9, 2011

(54) AUXILIARY FASTENING DEVICE FOR ASSISTING TRANSDUCER BEING FASTENED AND ISOLATING VIBRATION INDUCED DURING OPERATION OF TRANSDUCER

(75) Inventor: Chen Ming Yu, Taoyuan (TW)

(73) Assignee: AU Optronics Corporation, Science-Based Industrial Park, Hsinchu (TW)

( * ) Notice: Subject to any disclaimer, the term of this patent is extended or adjusted under 35 U.S.C. 154(b) by 1041 days.

(21) Appl. No.: 11/832,666

(22) Filed: Aug. 2, 2007

(65) Prior Publication Data

US 2008/0031485 A1 Feb. 7, 2008

(30) Foreign Application Priority Data

Aug. 2, 2006 (TW) ..... 95128238 A

(51) Int. Cl.
*H04R 25/00* (2006.01)

(52) U.S. Cl. ..... 381/386; 381/333; 381/388

(58) Field of Classification Search ..... 381/306, 381/87, 332, 333, 152, 353, 354, 386, 388, 381/392, 395; 181/198, 199; 361/679.23, 361/679.26, 679.55

See application file for complete search history.

(56) References Cited

U.S. PATENT DOCUMENTS 5,689,574 A * 11/1997 Heirich et al. ..... 381/354
6,760,460 B1 * 7/2004 Jeon ..... 381/388
6,990,212 B2 * 1/2006 Kambe ..... 381/386

* cited by examiner

*Primary Examiner* — Huyen D Le
(74) *Attorney, Agent, or Firm* — Winston Hsu; Scott Margo

(57) ABSTRACT

The invention provides an auxiliary fastening device for assisting in fastening a transducer such as a speaker on a base structure. Moreover, the auxiliary fastening device according to the invention is capable of isolating the vibration induced from the transducer to the base structure during operation.

17 Claims, 5 Drawing Sheets

AUXILIARY FASTENING DEVICE FOR ASSISTING TRANSDUCER BEING FASTENED AND ISOLATING VIBRATION INDUCED DURING OPERATION OF TRANSDUCER

BACKGROUND OF THE INVENTION

1. Field of the Invention

The invention relates to an auxiliary fastening device for assisting in fastening a transducer on a base structure and, more particularly, to an auxiliary fastening device capable of isolating a vibration induced during the operation of the transducer.

2. Description of the Prior Art

Most of transducers, e.g. a speaker, make noise and induce vibration during operation.

When a transducer, e.g. a speaker, makes noise during operation, the transducer will do a linear reciprocating movement, and the sound wave generated by the transducer may induce the resonance phenomenon of sound.

With the poor design of the support and fastening structure of the transducer, when the transducer makes noise during operation, the normal linear reciprocating movement of the transducer will be interfered; as a result, it may induce the deformation in the transducer itself or in the parts of the support and fastening structures.

Moreover, when the transducer makes noise during operation, the sound wave generated by the transducer and the related components of the support and fastening structure of the transducer may induce the resonance phenomenon of sound to affect the quality of sound.

In order to solve the above mentioned problems, some inventions have been disclosed. For examples, U.S. Pat. Nos. 5,682,021, 5,956,412, 6,654,472, 6,744,903, 6,760,460, and 6,990,212.

However, the inventions disclosed by the above mentioned patents have common problems; that is, they have complicated structure and inconvenience of the assembly.

Therefore, a scope of the invention provides an auxiliary fastening device which has a simple structure and is convenient to be assembled; moreover, it is capable of isolating a vibration induced during the operation of the transducer.

SUMMARY OF THE INVENTION

A scope of the invention provides an auxiliary fastening device. The auxiliary fastening device is used to assist in fastening a transducer on a base structure, and is capable of isolating a vibration induced during the operation of the transducer. Moreover, the auxiliary fastening device has some advantages such as simple structure and convenience of the assembly.

The transducer includes a first main body with a first formed-trough fastening hole and a second formed-through fastening hole. And, the position of the second fastening hole is symmetrical to the position of the first fastening hole.

The first preferred embodiment based on the invention is an auxiliary fastening device including a second main body, a first boss, and a second boss. The second main body is made of a shock-absorbing material, and is capable of being fastened on the base structure. The first boss is made of the shock-absorbing material and protruded from the second main body. And, the first boss is corresponding to the first fastening hole, and its structure fits the corresponding first fastening hole. Besides, the first boss also has a respective free end and a respective bonding end in a form of a retainer. The second boss is protruded from the second main body. And, the second boss is corresponding to the second fastening hole, and its structure fits the corresponding second fastening hole.

The second preferred embodiment based on the invention is a display device including a housing, a speaker, and an auxiliary fastening device. The speaker includes a first main body. The first main body has a first formed-trough fastening hole and a second formed-through fastening hole. And, the position of the second fastening hole is symmetrical to the position of the first fastening hole. As to the auxiliary fastening device, it includes a second main body, a first boss, and a second boss. The second main body is made of a shock-absorbing material, and is capable of being fastened on the housing. The first boss is made of the shock-absorbing material and protruded from the second main body. The first boss is also corresponding to the first fastening hole and its structure fits the corresponding first fastening hole. Besides, the first boss has a respective free end and a respective bonding end in a form of a retainer.

The second boss is protruded from the second main body. And, the second boss is corresponding to the second fastening hole, and its structure fits the corresponding second fastening hole.

The advantage and spirit of the invention may be further understood by the following recitations together with the appended drawings.

BRIEF DESCRIPTION OF THE APPENDED DRAWINGS

DETAILED DESCRIPTION OF THE INVENTION

Figure 1:
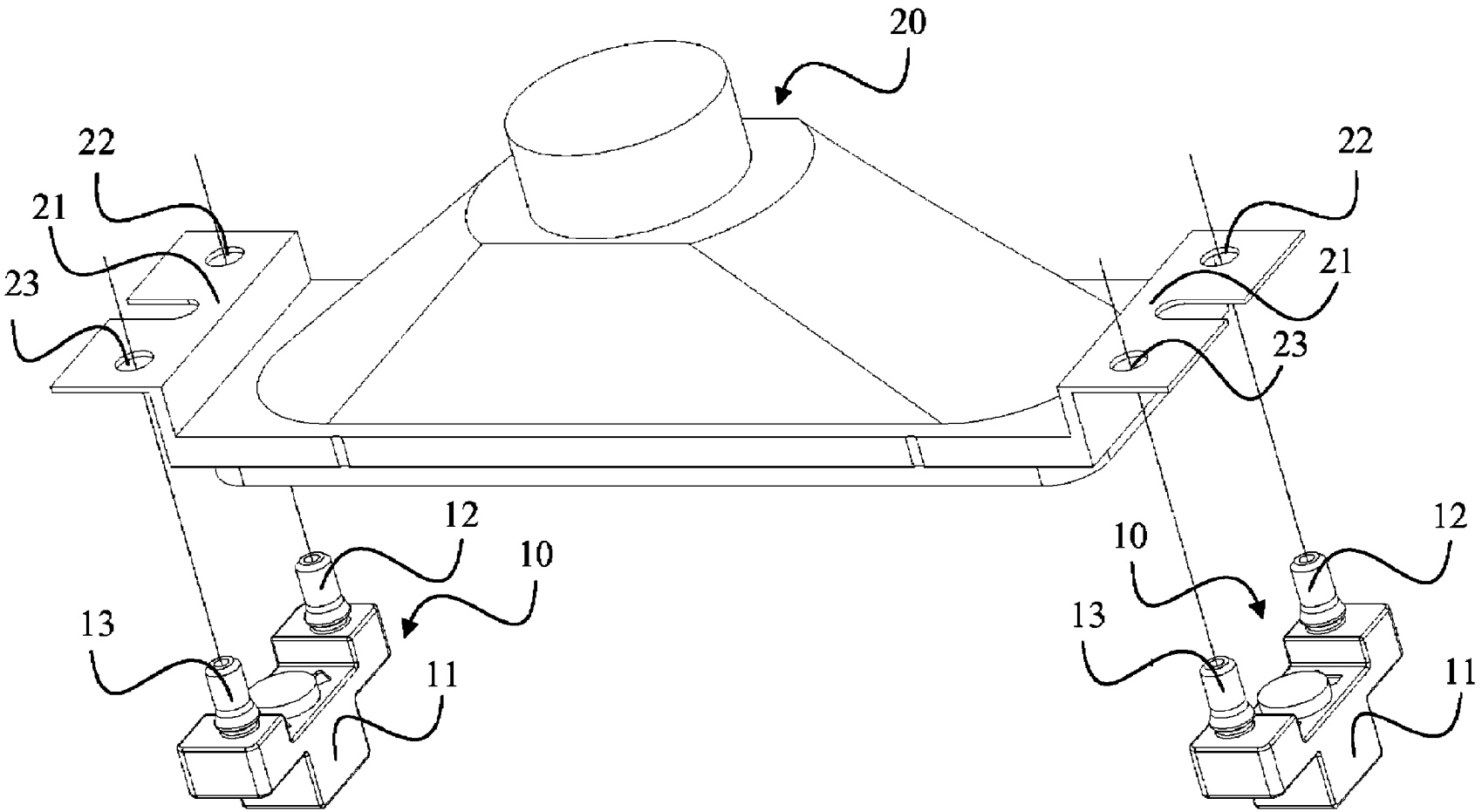
FIG. 1 is an appearance schematic diagram of an auxiliary fastening device and a transducer of a preferred embodiment based on the invention.
Figure 2:
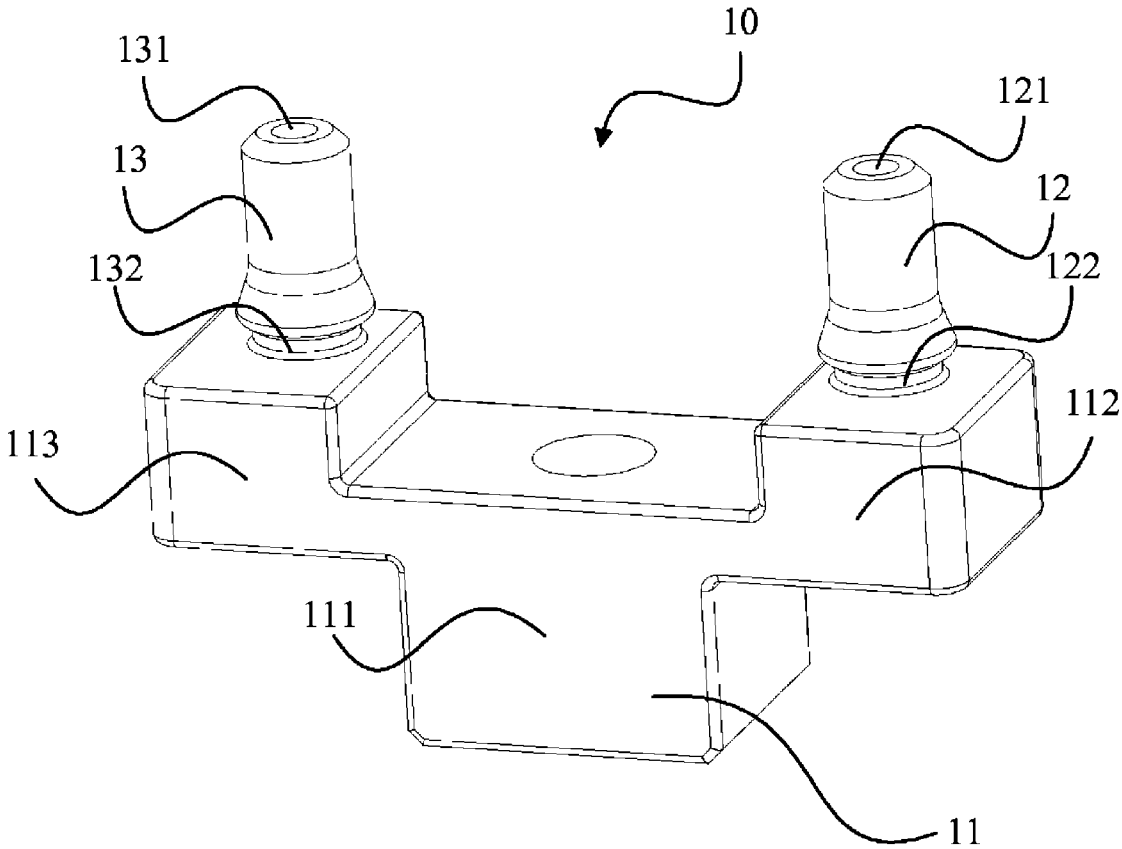
FIG. 2 is an appearance schematic diagram of an auxiliary fastening device in FIG. 1.

Referring to FIG. 1 and FIG. 2, FIG. 1 is an appearance schematic diagram of an auxiliary fastening device and a transducer according to the first preferred embodiment based on the invention. FIG. 2 is an appearance schematic diagram of an auxiliary fastening device in FIG. 1.

As shown in FIG. 1 and FIG. 2, both sides of the transducer 20 respectively include a first main body 21. Both the first main bodies 21 have a first formed-trough fastening hole 22 and a second formed-through fastening hole 23. The position of the second fastening hole 23 is symmetrical to the position of the first fastening hole 22. And, the transducer 20 can be a speaker.

The first preferred embodiment based on the invention is an auxiliary fastening device 10 including a second main body 11, a first boss 12, and a second boss 13.

The second main body 11 is made of a shock-absorbing material, and the second main body 11 is capable of being fastened on the base structure (not shown in FIG. 1 and FIG. 2).

The first boss 12 is made of the shock-absorbing material and protruded from the second main body 11. And, the first boss 12 is corresponding to the first fastening hole 22 and its structure fits the corresponding first fastening hole 22. Besides, the first boss 12 also has a respective free end 121 and a respective bonding end 122 in a form of a retainer.

In an embodiment, when the first fastening hole 22 which is corresponding to the first boss 12 is fit for the bonding end of the first boss 12, the first fastening hole 22 will clamp the bonding end of the first boss 12.

In an embodiment, the shock-absorbing material can be a rubber or a polymer material.

The second boss 13 is protruded from the second main body 11. And, the second boss 13 is corresponding to the second fastening hole 23 and its structure fits the corresponding second fastening hole 23.

In an embodiment, the second boss 13 is made of the shock-absorbing material.

In an embodiment, the second boss 13 has a respective free end 121 and a respective bonding end 122 in a form of a retainer. When the second fastening hole 23 which is corresponding to the second boss 13 is fit to the bonding end of the second boss 13, the second fastening hole 23 will clamp the bonding end of the second boss 13.

In an embodiment, as shown in FIG. 2, the second main body 11 includes a central portion 111, a first cantilever beam 112, and a second cantilever beam 113. The first cantilever beam 112 is extended from a first side of the central portion 111, and a second cantilever beam 113 is extended from a second side of the central portion 111. The second side is opposite to the first side. And, the first boss 12 is protruded from the first cantilever beam 112, and the second boss 13 is protruded from second cantilever beam 113.

Figure 3:
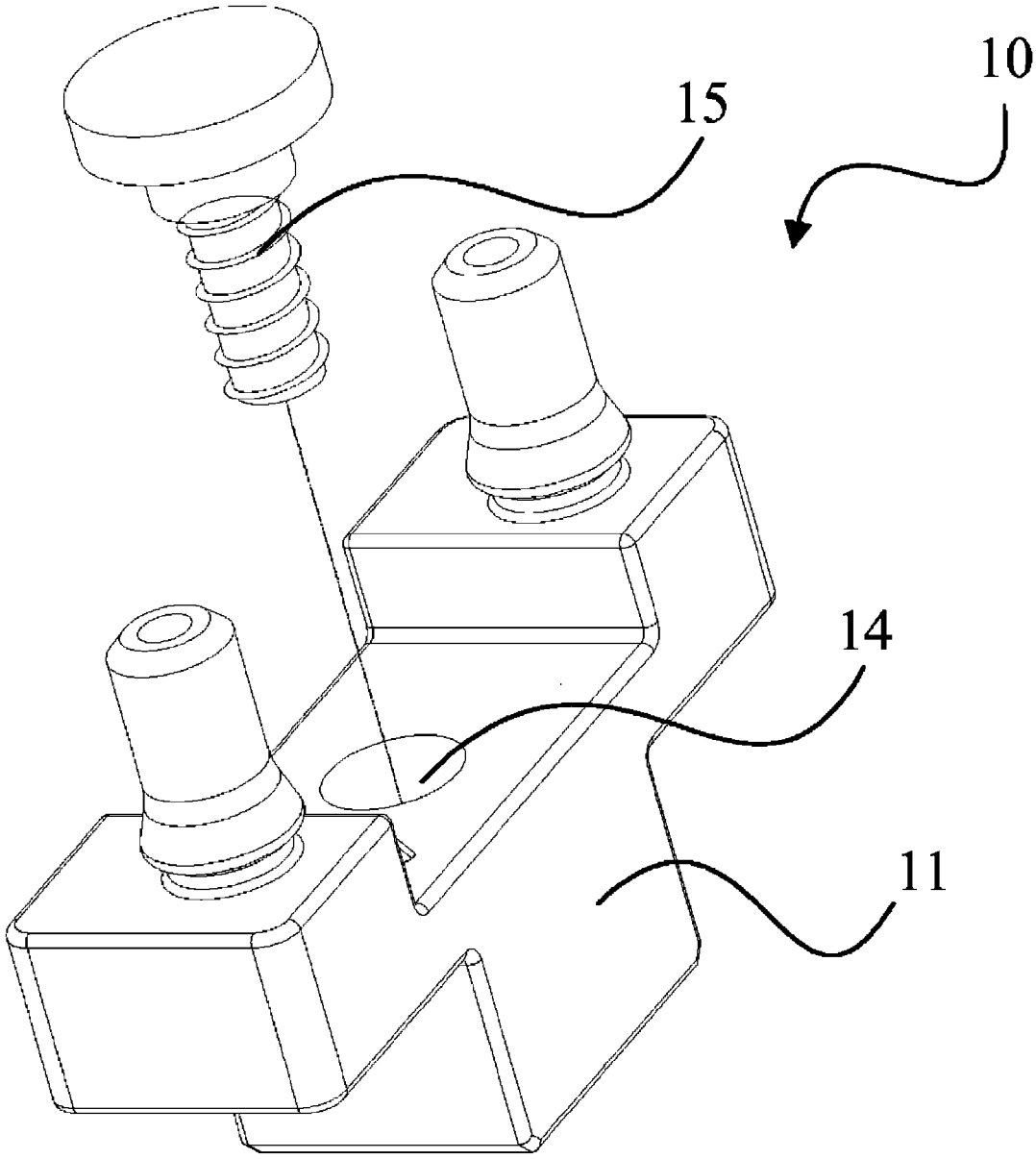
FIG. 3 is an appearance schematic diagram of an auxiliary fastening device and a fit screw.

Referring to FIG. 3, the central portion 111 has an aperture 14. The auxiliary fastening device 10 further includes a screw 15, and the second main body 11 is fastened on the base structure (not shown in FIG. 3) by inserting the screw 15 through the aperture 14 and screwing the screw 15 into the base structure (not shown in FIG. 3).

Figure 4:
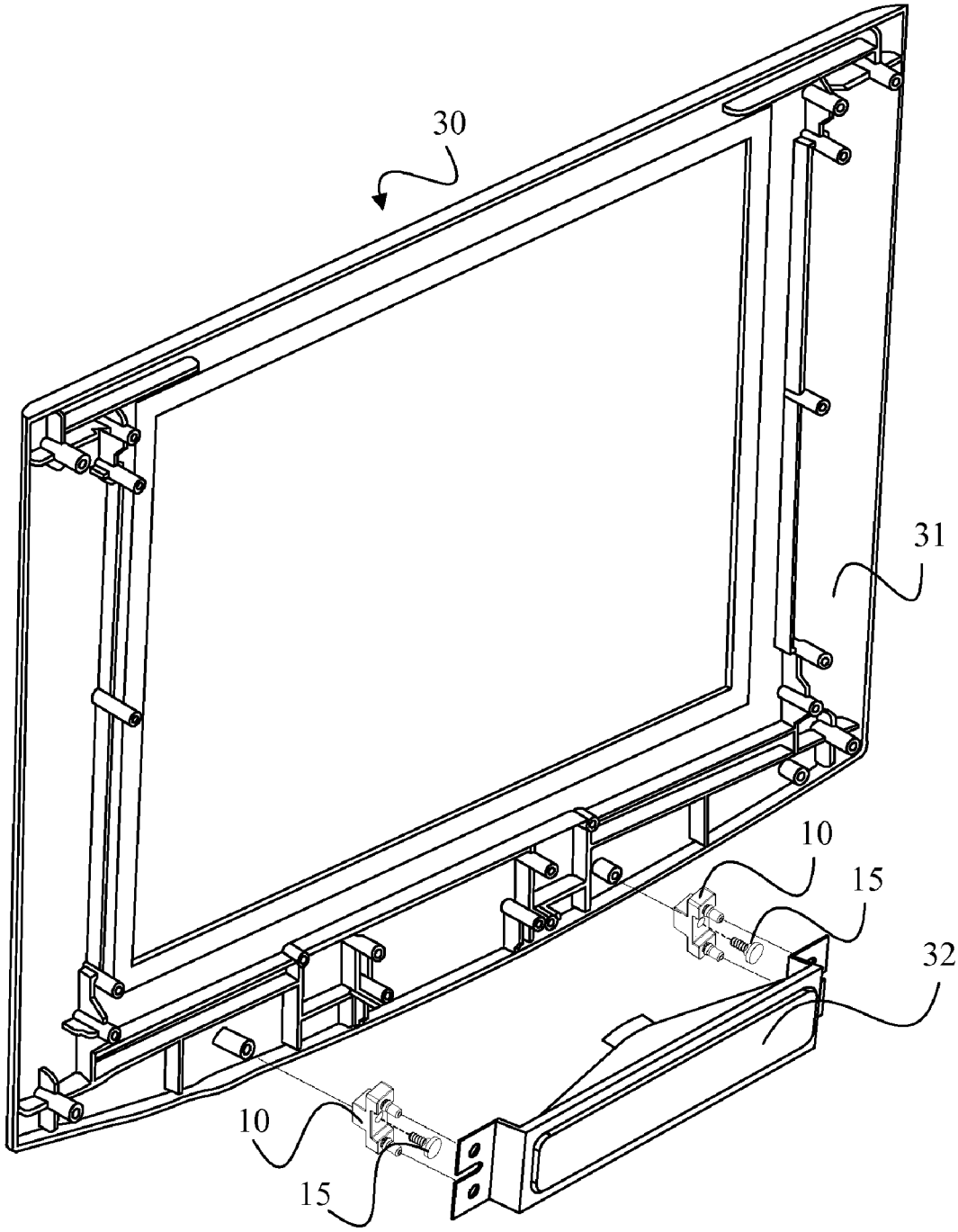
FIG. 4 is a partial device explosion diagram of the display device of the second preferred embodiment based on the invention.

Referring to FIG. 4, FIG. 4 is a partial explosion diagram of the display device of the second preferred embodiment based on the invention. The display device 30 of the second preferred embodiment based on the invention includes a housing 31, a speaker 32, and an auxiliary fastening device 10.

The speaker 32 is a kind of the transducer stated in the above mentioned first preferred embodiment. The structure of the speaker 32 is the same as the structure of the transducer stated in the above mentioned first preferred embodiment.

The auxiliary fastening device 10 is the auxiliary fastening device of the first preferred embodiment. Thus, the detail of the structure of the auxiliary fastening device in the embodiment is not mentioned again herein.

As shown in FIG. 4, the two auxiliary fastening devices 10 are first fastened on a housing of the display device by using a screw 15 respectively.

Figure 5:
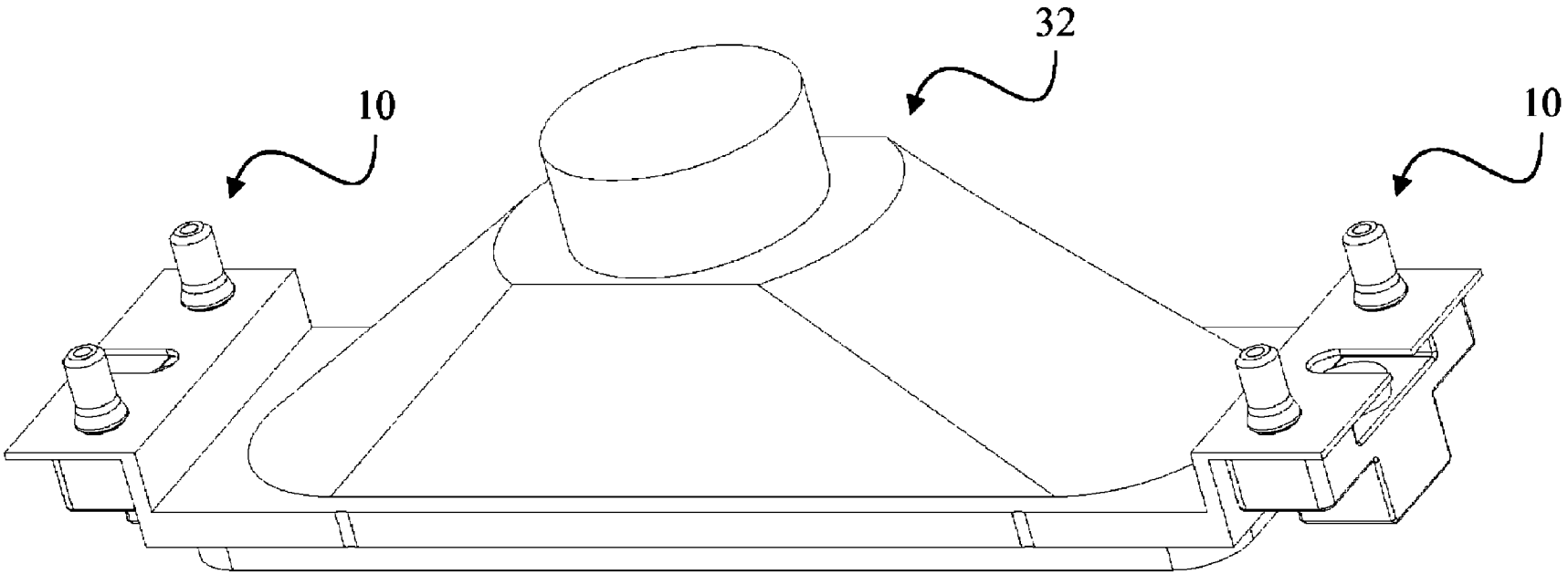
FIG. 5 is an appearance schematic diagram of clamping an auxiliary fastening device by a transducer of a preferred embodiment based on the invention.

Afterward, the speaker 32 is installed on the two auxiliary fastening devices 10, as shown in FIG. 5.

In practical applications, a transducer is installed on a base structure by using an auxiliary fastening device of a preferred embodiment based on the invention. The following is the steps of installation.

First, a screw is inserted into an aperture of the auxiliary fastening devices. Namely, the screw is screwed into the base structure to fasten the auxiliary fastening devices on the base structure.

Afterward, the first fastening hole and the second fastening hole on the transducer are fit for the first boss and the second boss on the auxiliary fastening device respectively.

Finally, the first boss and the second boss are pinched and pulled up by hands. The bonding ends in a form of a retainer of the first boss and the second boss will be clamped by the first formed-trough fastening hole and the second formed-trough fastening hole of the transformer.

When the transducer makes noise during operation, the transducer will do a linear reciprocation and generate vibration. Because the auxiliary fastening device is substantially made of the shock-absorbing material, for example, a rubber or a polymer material, the reciprocation is not interfered; as a result, the vibration generated by the transducer can be absorbed without damaging other related components.

Obviously, the auxiliary fastening device of the first preferred embodiment based on the invention can assist in fastening a transducer on a base structure and isolate the vibration induced during the operation of the transducer without damaging other related components. Moreover, the auxiliary fastening device has simple structure and can be made monolithically. When the auxiliary fastening device is used for the practical assembly, the auxiliary fastening device also has an advantage of the convenience of assembly.

With the recitations of the preferred embodiment above, the features and spirits of the invention will be hopefully well described. However, the scope of the invention is not restricted by the preferred embodiment disclosed above. The objective is that all alternative and equivalent arrangements are hopefully covered in the scope of the appended claims of the invention. Accordingly, the above disclosure should be construed as limited only by the metes and bounds of the appended claims.

What is claimed is:

1. An auxiliary fastening device for assisting in fastening a transducer on a base structure, and isolating a vibration induced during the operation of the transducer from the base structure, the transducer comprising a first main body with a first formed-through fastening hole and a second formed-through fastening hole, the position of the second fastening hole being symmetrical to the position of the first fastening hole, the auxiliary fastening device comprising:

a second main body being capable of being fastened on the base structure;

a first boss, protruded from the second main body, the first boss corresponding to the first fastening hole and its structure fitting the corresponding first fastening hole, the first boss having a respective free end and a respective bonding end in a form of a retainer; and a second boss, protruded from the second main body, the second boss corresponding to the second fastening hole and its structure fitting the corresponding second fastening hole.

2. The auxiliary fastening device of claim 1, wherein when the first fastening hole corresponding to the first boss is fitted to the bonding end of the first boss, the first fastening hole clamps the bonding end of the first boss.

3. The auxiliary fastening device of claim 1, wherein the second main body, the first boss and the second boss are made of a shock-absorbing material.

4. The auxiliary fastening device of claim 1, wherein the second boss has a respective free end and a respective bonding end in a form of a retainer.

5. The auxiliary fastening device of claim 4, wherein when the second fastening hole corresponding to the second boss is fit for the bonding end of the second boss, the second fastening hole clamps the bonding end of the second boss.

6. The auxiliary fastening device of claim 1, wherein the second main body comprises a central portion, a first cantilever beam extended from a first side of the central portion, and a second cantilever beam extended from a second side of the central portion, the second side is opposite to the first side, the first boss is protruded from the first cantilever beam, and the second boss is protruded from the second cantilever beam.

7. The auxiliary fastening device of claim 6, wherein the central portion has an aperture, the auxiliary fastening device further comprises a screw, and the second main body is fastened on the base structure by inserting the screw through the aperture and screwing the screw into the base structure.

8. The auxiliary fastening device of claim 1, wherein the transducer is a speaker.

9. The auxiliary fastening device of claim 1, wherein the second main body, the first boss and the second boss are monolithically formed.

10. A display device, comprising:

a housing;

a speaker comprising a first main body with a first formed-trough fastening hole and a second formed-through fastening hole, the position of the second fastening hole being symmetrical to the position of the first fastening hole; and an auxiliary fastening device, comprising:

a second main body being capable of being fastened on the housing;

a first boss, protruded from the second main body, the first boss corresponding to the first fastening hole and its structure fitting the corresponding first fastening hole, the first boss having a respective free end and a respective bonding end in a form of a retainer; and a second boss, protruded from the second main body, the second boss corresponding to the second fastening hole and its structure fitting the corresponding second fastening hole.

11. The display device of claim 10, wherein when the first fastening hole corresponding to the first boss is fit for the bonding end of the first boss, the first fastening hole clamps the bonding end of the first boss.

12. The display device of claim 10, wherein the second main body, the first boss and the second boss are made of a shock-absorbing material.

13. The display device of claim 10, wherein the second boss has a respective free end and a respective bonding end in a form of a retainer.

14. The display device of claim 13, wherein when the second fastening hole corresponding to the second boss is fitted to the bonding end of the second boss, the second fastening hole clamps the bonding end of the second boss.

15. The display device of claim 10, wherein the second main body comprises a central portion, a first cantilever beam extended from a first side of the central portion, and a second cantilever beam extended from a second side of the central portion, the second side is opposite to the first side, the first boss is protruded from the first cantilever beam, and the second boss is protruded from second cantilever beam.

16. The display device of claim 15, wherein the central portion has an aperture, the auxiliary fastening device further comprises a screw, and the second main body is fastened on the base structure by inserting the screw through the aperture and screwing the screw into the base structure.

17. The display device of claim 10, wherein the second main body, the first boss and the second boss are monolithically formed.

* * * * *